US005662227A

United States Patent [19]

Laitinen

[11] Patent Number: 5,662,227

[45] Date of Patent: Sep. 2, 1997

[54] APPARATUS FOR LENGTH SCREENING OF ELONGATED PARTICLES

[75] Inventor: Jarmo Laitinen, Hyvinkää, Finland

[73] Assignee: Sunds Defibrator Loviisa Oy, Finland

[21] Appl. No.: 595,539

[22] Filed: Feb. 2, 1996

[30] Foreign Application Priority Data

Feb. 6, 1995 [FI] Finland ..... 950518

[51] Int. Cl.[6] ..... B07B 13/05

[52] U.S. Cl. ..... 209/667

[58] Field of Search ..... 209/667, 668, 209/671, 672, 674, 673, 683, 689, 691

[56] References Cited

U.S. PATENT DOCUMENTS

| | | | |
|---|---|---|---|
| 2,624,458 | 9/1953 | Molnau | 209/107 |
| 4,240,902 | 12/1980 | Agee et al. | 209/667 X |
| 4,405,050 | 9/1983 | Fenton, Jr. et al. | 209/668 |
| 4,627,541 | 12/1986 | Johnson | 209/668 |
| 4,979,624 | 12/1990 | Ellis | 209/668 X |
| 5,060,806 | 10/1991 | Savage | 209/668 |

FOREIGN PATENT DOCUMENTS

| | | | |
|---|---|---|---|
| 406154712 | 6/1994 | Japan | 209/668 |

*Primary Examiner*—D. Glenn Dayoan

*Attorney, Agent, or Firm*—Flehr Hohbach Test Albritton & Herbert LLP

[57] ABSTRACT

An apparatus for length screening of elongated particles such as wood chips, having a roll set (2) formed by at least two essentially horizontal rolls, mounted parallel to each other and adapted to rotate with a gap (5) adjusted between each pair of rolls, and on which roll set the material to be screened is fed essentially orthogonally to the longitudinal axis of the rolls at the intake end of the roll set, whereafter a portion of the material to be screened falls down through the gaps (5) and a remaining portion is removed from the exit end of the apparatus. At least one of the individual rolls (4) of the roll set (2) have their circumference formed by cage bars (9) aligned parallel with the longitudinal axis of the roll, the cage bars being arranged essentially equidistantly spaced from each other so as to form a cage and the cage bars having ends being attached to flanges (8) or similar members having a circular or annular perimeter, the flanges being positioned perpendicular to the longitudinal axis of the roll and the flanges being attached to the shaft (7) of the roll.

5 Claims, 2 Drawing Sheets

APPARATUS FOR LENGTH SCREENING OF ELONGATED PARTICLES

BACKGROUND OF THE INVENTION

In mechanical wood processing industry a need arises, e.g., in saw mills and manufacturing processes of wood-based boards for an apparatus capable of length screening of particles mostly comprising elongated wood particles. Such raw materials include various sawing residues, chipped veneer residues from plywood manufacture, as well as the relatively large OSB (oriented structural board) and waferboard slices typically employed in the North-American wood-based particleboard production.

Chipped veneer residues obtained from plywood manufacture contain particles often deviating from the normal chip length by being comprising of vastly overlength veneer splinters that must be screened away from the fraction of normal size chips to permit successful further processing of the veneer residue material.

To optimize the properties of OSBs and waferboards as to, e.g., their flexural strength, advantageously the shortest slices obtained from the slicing machine are screened entirely away from the process and the fraction of remaining short slices is chiefly used in laying the core of the board, while the fraction of longer slices is laid on the surface layers. To implement such fractionation, an effective method of length screening of the slice stock is required.

Currently, length screening is chiefly attempted by using planar, drum or disk screens giving, however, unsatisfactory screening results. The screen openings of planar and drum screens easily permit the passage of overlong particles to the wrong side of the screen if the particles are sufficiently narrow and thin to negotiate the screen openings.

In a disk screen, the shafts driving the disks have a relatively small diameter, whereby the shafts cannot contribute to the actual screening process. Hence, when length screening is attempted by means of a disk screen, the design of such a screen is based on the assumption that the longer wood particles would also be thicker. This assumption is not universally valid, however, because particles of relatively large length may still be very thin: for instance, long veneer splinters or thin OSB slices made with a slicing machine are unsuitable for sufficiently effective length screening with a disk screen which is actually developed for thickness screening.

EP patent application no 89630079.5 (publication no. 0340148) discloses a screening apparatus for chip-like materials, said apparatus being formed by adjacently mounted elongated rolls on which are arranged stop rings with a slightly larger diameter than that of the roll, said stop rings being spaced from each other at a distance. Such a construction offers a reasonably good function, yet at a relatively high cost.

SUMMARY OF THE INVENTION

An embodiment of the apparatus according to the invention is characterized in that the density of the longitudinal bars along the circumference of the rolls at the intake end of the roll set is higher than in the rolls of the exit end of the roll set, whereby the number of the cage bars per roll is, e.g., 12 in the intake end rolls and 6 in the exit end rolls, and that the widths of the interroll gaps are individually adjustable so that the gap widths increase toward the end of the roll set.

Another embodiment of the apparatus according to the invention is characterized in that each roll has from two to five, advantageously three flanges mounted perpendicular to the shaft of the roll for the purpose of mounting the cage bars on them.

A still another embodiment of the apparatus according to the invention is characterized in that the perpendicular flanges on the roll shaft are attached by welding to the roll shaft and that the longitudinal cage bars forming the roll circumference are in turn attached by welding to the perimeter of the flanges.

The screening apparatus according to the invention has been found to perform very effectively in fractionating screening of chips according to their length.

DESCRIPTION OF THE PREFERRED EMBODIMENTS

Figure 1:
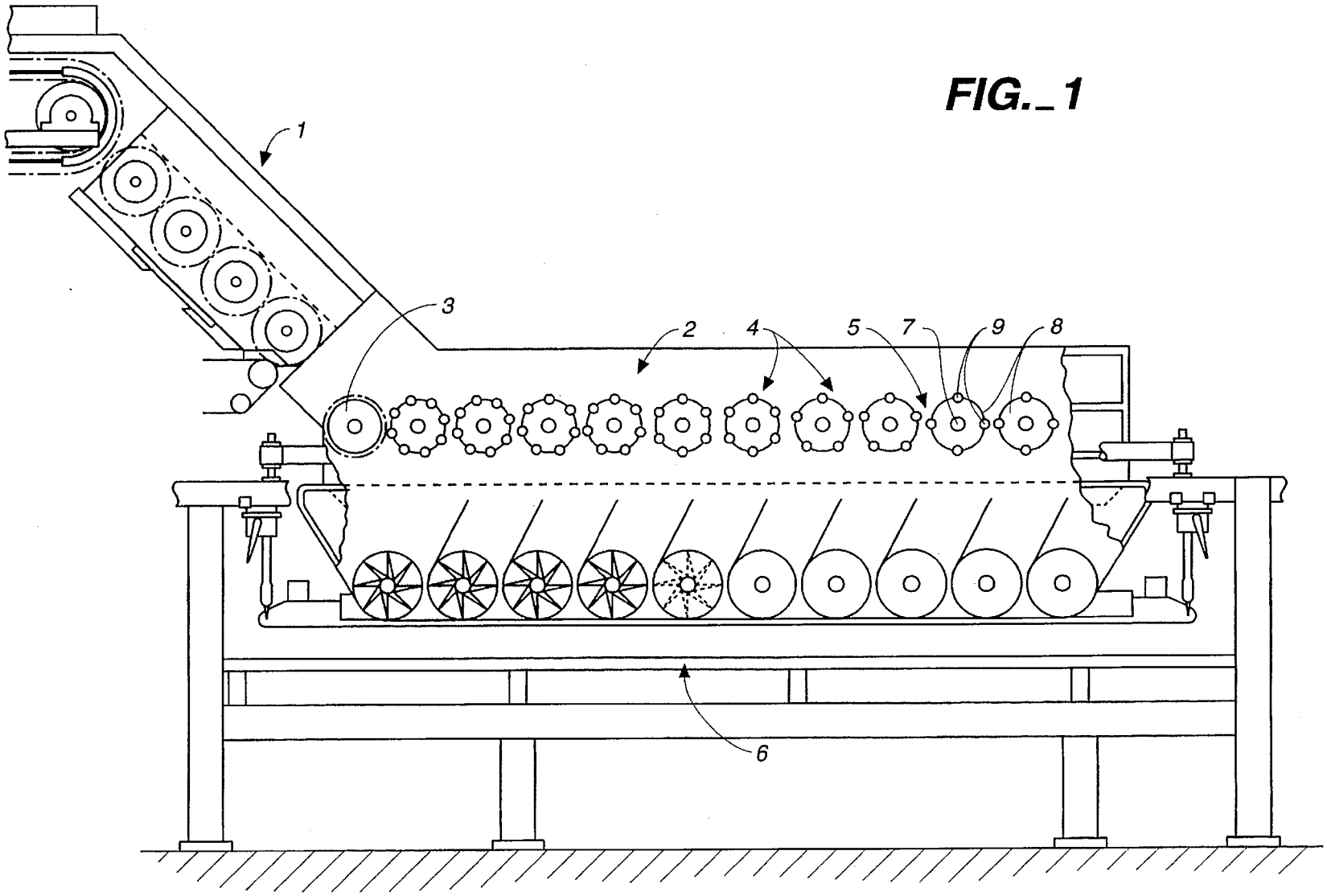
FIG. 1 shows a side view of a screening apparatus according to the invention mounted above a chip alignment unit.

Referring to FIG. 1, the screening arrangement shown therein comprises an intake roll set 1 along which the material to be screened, principally comprised of chips of different lengths, is red onto an accelerating roll 3 running at a high speed and having a suitable coarse surface pattern so that the material to be screened is thrown onto a roll set 2 according to the invention, said roll set comprising at least two essentially horizontal, essentially parallel to each other mounted, advantageously rotating rolls 4, which are spaced from each other by gaps 5, whereby a portion of the material to be screened can fall down through the interroll gaps and the other portion is removed from the exit end of the roll set. The interroll gaps 5 may be individually adjustable in the manner as described in FI patent application no. 922777, for instance. Advantageously, the gaps 5 are staged in an order of increasing gap width toward the exit end of the roll set 2. In the view of the diagram, the rotational direction of the accelerating roll 3 as well as the rolls 4 of the roll set is clockwise.

Under the roll set 2 is in the illustrated exemplifying embodiment arranged an entirely conventional chip alignment unit 6. Different kinds of chip alignment units are known in the art for alignment in both cross-machine as well as machine direction, of which either type can be used with the present invention as desired. Obviously, any other type of structure such as bins, conveyors and others can be adapted under the roll set.

Figure 2:
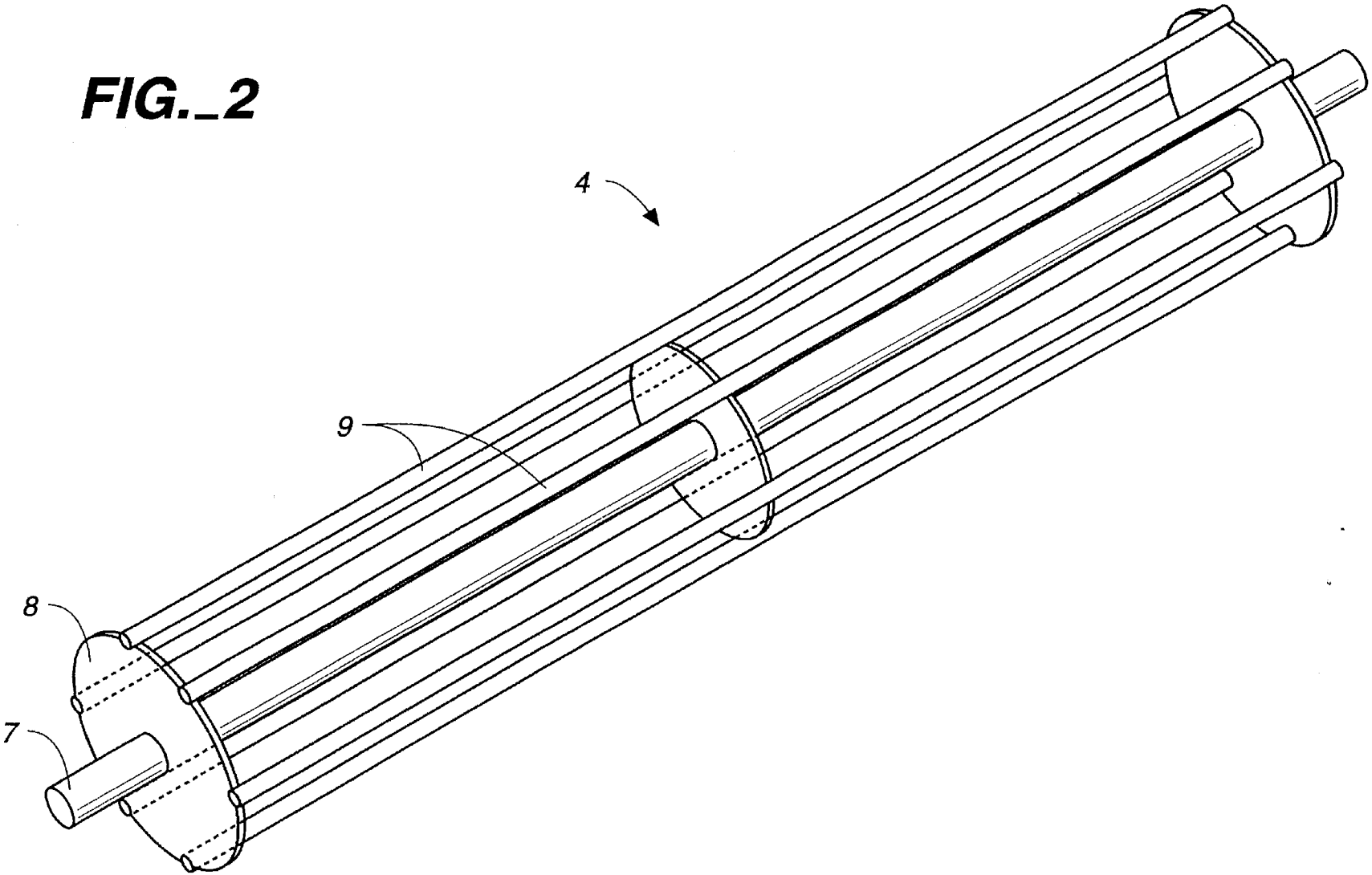
FIG. 2 shows a perspective view of the bar cage roll employed in the invention.

Referring to FIG. 2, the structure of a single roll 4 of the roll set 2 is illustrated in greater detail therein. The roll is comprised of a center shaft 7, at least two flanges 8 attached, advantageously by welding, to the center shaft 7, and of longitudinal roll cage bars 9 that are attached, advantageously by welding, to the flanges so as to form the circumference of the roll. The cage bars 9 are arranged essentially equidistantly spaced from each other along the circumference of the roll and the number of the bars can be varied as desired, typically from 6 to 12. For instance, in the embodiment of the roll set 2 illustrated in FIG. 1, the intake end rolls 4 have 12 pcs. cage bars, while the exit end rolls have 6 pcs. cage bars per roll. The number of bars per roll in the intermediate rolls may be varied smoothly stepped or in more discrete steps. Also the number of the flanges 8, which are adapted perpendicular to the longitudinal axis of the roll, may be freely varied. Advantageously, the perimeter of the flanges is circular. Thus, the flanges may be designed into disks or annular elements. In the diagram is shown an embodiment in which the number of the flanges is 3, while as well 2, 4, 5 or a greater number of flanges may be employed.

Followingly, the function of the apparatus according to the invention is such that material to be subjected to length screening is fed to the intake end of the roll set 2, in the illustrated case via an intake roll set 1. The accelerating roll 3 throws the material onto the roll set 2, on which the rotational motion of the rolls 4 and the above-described cage structure of the rolls conveys the material blanket forward. When moving on the roll set, the material comprised of elongated particles tends to align so that not even the narrowest slices can fall down through the interroll gaps prematurely. The rotating rolls 4 elevate, particularly at the intake end of the roll set, the elongated particles upward from the interroll gaps 5 thus preventing their premature downward passage.

To those versed in the art it is obvious that the invention is not limited by the exemplifying embodiments described above, but rather, may be varied within the scope and spirit of the annexed claims. Accordingly, the construction of the apparatus framework, bearing arrangement of the rolls, roll drive machinery and other details may be considered known to a craftsman, whereby their detailed description may be omitted herein. Such design parameters as the width of the roll set, roll diameters and the number of the rolls as well as their rotational speeds are dictated by the desired screening capacity and the properties of the material to be length screened. When desired, the intake roll set 1 preceding the screening roll set 2 proper may be omitted or replaced by another type of conveying device or similar arrangement.

I claim:

1. An apparatus for length screening of elongated particles, said apparatus comprising a roll set (2) comprising at least two spaced-apart generally horizontal rolls (4), mounted generally parallel to one another and adapted to rotate with a gap (5) between successive spaced-apart rolls (4), characterized in that at least one of the spaced-apart rolls (4) of the roll set (2) has a circumference defined by longitudinally-extending cage bars (9) aligned parallel with a longitudinal axis of the roll (4), said cage bars (9) being arranged generally equidistantly spaced from one another so as to form a cage and said cage bars (9) having ends attached to planar members (8), said planar members having an annular perimeter, said planar members (8) being attached to a longitudinally-extending shaft (7) of roll (4) such that the plane of said planar members (8) is perpendicular to the longitudinal axis of the roll (4), wherein, said apparatus has an intake end and an exit end, and the number of longitudinally-extending cage bars (9) around the annular perimeter of each of said rolls (4) varies incrementally such that the number of longitudinally-extending cage bars (9) continually decreases from the intake end of the apparatus to the exit end of the apparatus, such that the widths of gaps (5) progressively increase in size from the intake end to the exit end of the apparatus.

2. An apparatus as defined in claim 1 characterized in that each roll (4) has from two to five members (8) attached thereto.

3. An apparatus as defined in claims 1 or 2 characterized in that members (8) are attached by welding to the roll (4) and wherein cage bars (9) defining the circumference of roll (4) are attached by welding to a perimeter of member (8).

4. An apparatus as defined in claims 1 or 2 or 3 further comprising:

an accelerating roll (3) proximal said intake end, said accelerating roll (3) adapted to throw said elongated particles onto said roll set (2).

5. The apparatus as defined in claim 1 wherein, said annular perimeter is a circular perimeter.

* * * * *

UNITED STATES PATENT AND TRADEMARK OFFICE

CERTIFICATE OF CORRECTION

PATENT NO. : 5,662,227

DATED : September 2, 1997

INVENTOR(S) : LAITINEN

It is certified that error appears in the above-identified patent and that said Letters Patent is hereby corrected as shown below:

At column 1, line 58, immediately following SUMMARY OF THE INVENTION, insert:

--The present invention relates to an apparatus for length screening of elongated particles such as wood chips, for instance, whereby said apparatus comprises a roll set formed by at least two essentially horizontal rolls, mounted essentially parallel to each other and advantageously adapted to rotate with a gap adjusted between each pair of rolls, and on which roll set the material to be screened is fed essentially orthogonally to the longitudinal axis of the rolls at the intake end of the roll set, whereafter a portion of the material to be screened falls down through the interroll gaps and the other portion is removed from the exit end of the roll set.--

At column 1, line 58, immediately preceding the paragraph beginning "An embodiment of", insert:

--It is an object of the present invention to provide an apparatus which offers a screening result of elongated particles superior to that obtained by conventional apparatuses and has a simple construction that thus is cost-effective to manufacture. The apparatus according to the invention is characterized in that at least a number of the individual rolls of the roll set are comprised of rolls having their circumference formed by a cage of bars aligned parallel with the longitudinal axis of the roll, said bars being arranged essentially equidistantly

UNITED STATES PATENT AND TRADEMARK OFFICE

CERTIFICATE OF CORRECTION

PATENT NO. : 5,662,227

DATED : September 2, 1997

INVENTOR(S) : LAITINEN

It is certified that error appears in the above-identified patent and that said Letters Patent is hereby corrected as shown below:

spaced from each other so as to form a cage acting as the circumference of the roll and said bars in turn being attached at their ends to flanges or similar members which are adapted perpendicular to the longitudinal axis of the roll and said flanges in turn being attached to the shaft of the roll.--

Signed and Sealed this

Twentieth Day of January, 1998

*Attest:*

Bruce Lehman

BRUCE LEHMAN

*Attesting Officer*

*Commissioner of Patents and Trademarks*